US005085231A

United States Patent [19]

Johnson

[11] Patent Number: 5,085,231

[45] Date of Patent: Feb. 4, 1992

[54] HAT-LIKE APPARATUS FOR DIRECTING AIR FLOW

[76] Inventor: Ronald A. Johnson, Rte. 1, Box 254, Union Grove, N.C. 28689

[21] Appl. No.: 520,669

[22] Filed: May 8, 1990

[51] Int. Cl.[5] ..... A24F 13/00

[52] U.S. Cl. ..... 131/329; 131/331; 2/171.3

[58] Field of Search ..... 131/329, 330, 331; 2/171.3

[56] References Cited

U.S. PATENT DOCUMENTS 3,735,423 5/1973 Droz ..... 2/171.3
4,858,627 8/1989 Netschert .
4,893,356 1/1990 Waters ..... 2/171.3

FOREIGN PATENT DOCUMENTS 3618760 12/1987 Fed. Rep. of Germany ..... 2/171.3

*Primary Examiner*—Richard J. Apley
*Assistant Examiner*—Lynne A. Reichard
*Attorney, Agent, or Firm*—Shefte, Pinckney & Sawyer

[57] ABSTRACT

A head-mounted, hat-like device includes components for guiding a stream of air flowing in a direction frontwardly of the face of the user and filter components for filtering the stream of air. The air flow guiding components include a fan fixedly mounted to a housing, a directional member mounted to the visor portion of the housing for directing air frontwardly of the person's face and a conduit for interconnecting the directional component and the fan device. The fan device draws ambient air including smoke and other by-products of burning tobacco through the directional component and along the conduit to be discharged by the fan device through a conventional tobacco by-product filter component, thereby cleansing the stream of air before it is released to the air space above the person.

11 Claims, 3 Drawing Sheets

HAT-LIKE APPARATUS FOR DIRECTING AIR FLOW

BACKGROUND OF THE INVENTION

The present invention relates to a hat-like apparatus for directing air flow and, more particularly, for directing the flow of air adjacent a user's face.

In certain situations such as, for example, when a person who is a smoker is present in a public facility, the person may be reluctant to smoke a tobacco product for fear of objection thereto by others in the immediate vicinity. However, it may not be practical or even possible for the smoker to position himself or herself adjacent ventilation such as an open window or a vent. Thus, the smoker's use of tobacco products may be undesirably limited.

Accordingly, the need exists for an apparatus which permits a smoker greater flexibility in the smoking of tobacco products.

SUMMARY OF THE INVENTION

The present invention provides an apparatus which permits a smoker to enjoy more flexibility in the smoking of tobacco products. Moreover, the present invention provides an apparatus which desirably enhances the air flowing in front of the user's face.

Briefly described, the present invention provides a hat-like apparatus for directing air flowing at the level of a person's face. The hat-like apparatus includes a housing removably mountable on the person's head, means, mounted to the housing for directing a stream of air to flow in a direction frontwardly of the person's face, and filter for filtering the stream of air.

In the preferred embodiment, the housing includes hat means for covering the head of the person. Additionally, the air stream directing means includes means for intaking ambient air into the housing, the intake ambient air flowing in front of the person's face when the apparatus is worn by the person. Also, the filter means includes means for removing selected products from the intake ambient air to produce filtered air and characterized further by means for exhausting the filtered air from the housing.

According to one aspect of the present invention, the hat-like apparatus is adapted for use by a person who is a smoker who releases combustion products during the smoking of tobacco-type products. The housing includes hat means for covering the head of the person, the air stream directing means includes means for intaking ambient air into the hat means and means for exhausting the filtered air from the hat means, the intake ambient air flowing in front of the smoker's face when the hat-like apparatus is worn by the smoker, and the filter means includes means for removing combustion products from the intake ambient air which have been released by the smoker thereinto to produce filtered air.

According to another aspect of the present invention, the hat-like apparatus includes a visor dependingly attached to the hat means and partially covering the face of the smoker when the hat means is worn by the smoker.

According to a further aspect of the present invention, the air stream guide means includes a selectively reversible fan means mounted to the housing and conduit means having a first opening disposed frontwardly of the person's face when the hat-like apparatus is worn by the person and a second opening spaced from the first opening. The fan means is operatively associated with the conduit means and selectively reversible to intake ambient air flowing in front of the person's face through the first opening and to expel the ambient air through the second opening and to draw intake ambient air through the second opening and to expel the ambient air through the first opening to flow in front of the person's face.

According to an additional further aspect of the present invention, the conduit means includes a ring member forming the second opening and means for supporting the ring member for orbital movement relative to the housing to effect selective positioning of the first opening relative to the person's face. Also, the filter means includes an air cooling medium for cooling air flowing therepast.

DETAILED DESCRIPTION OF THE PREFERRED EMBODIMENTS

Figure 1:
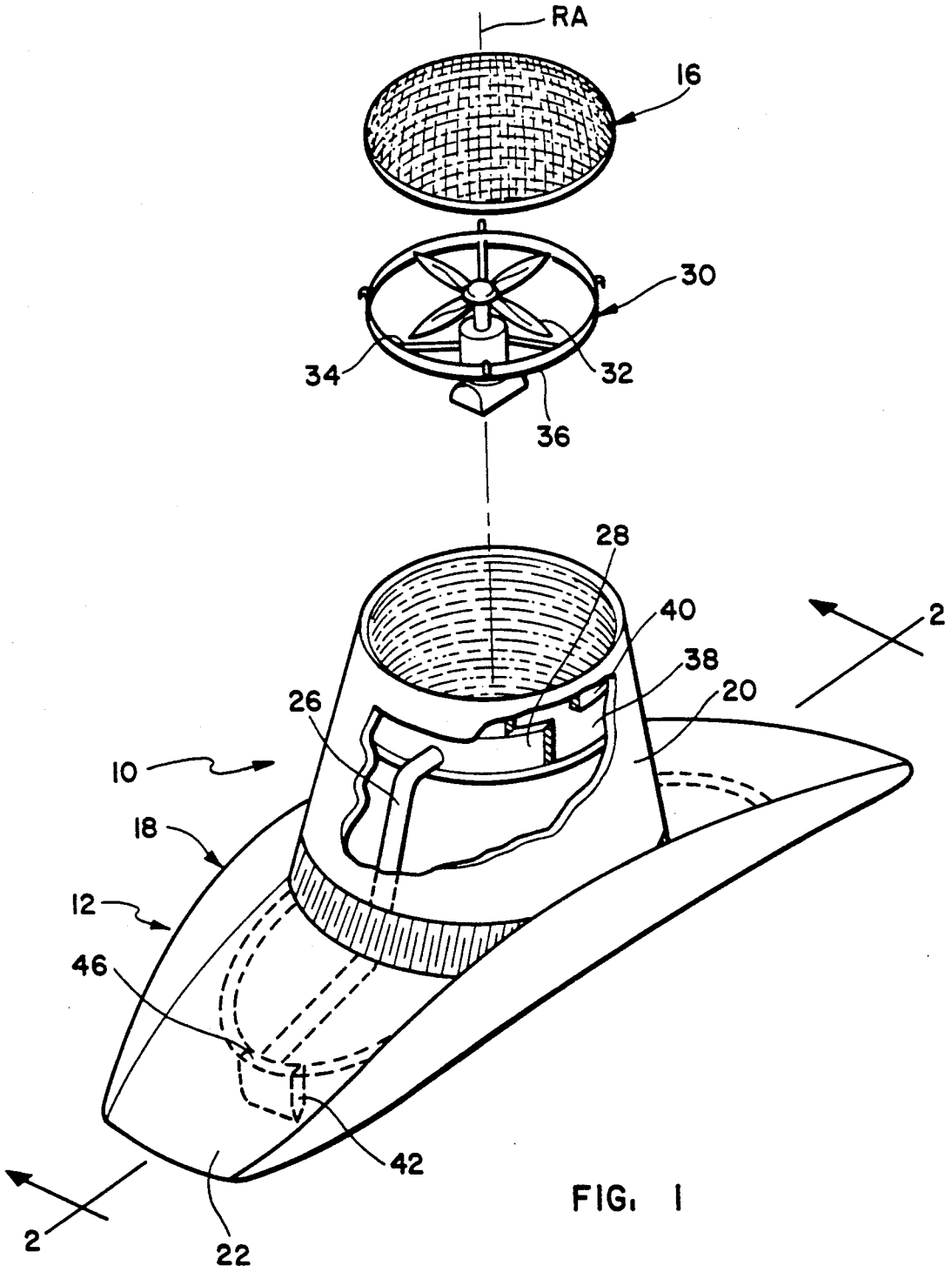
FIG. 1 is an exploded perspective view, partially broken away, illustrating one embodiment of a hat-like air flow directing apparatus of the present invention.
Figure 2:
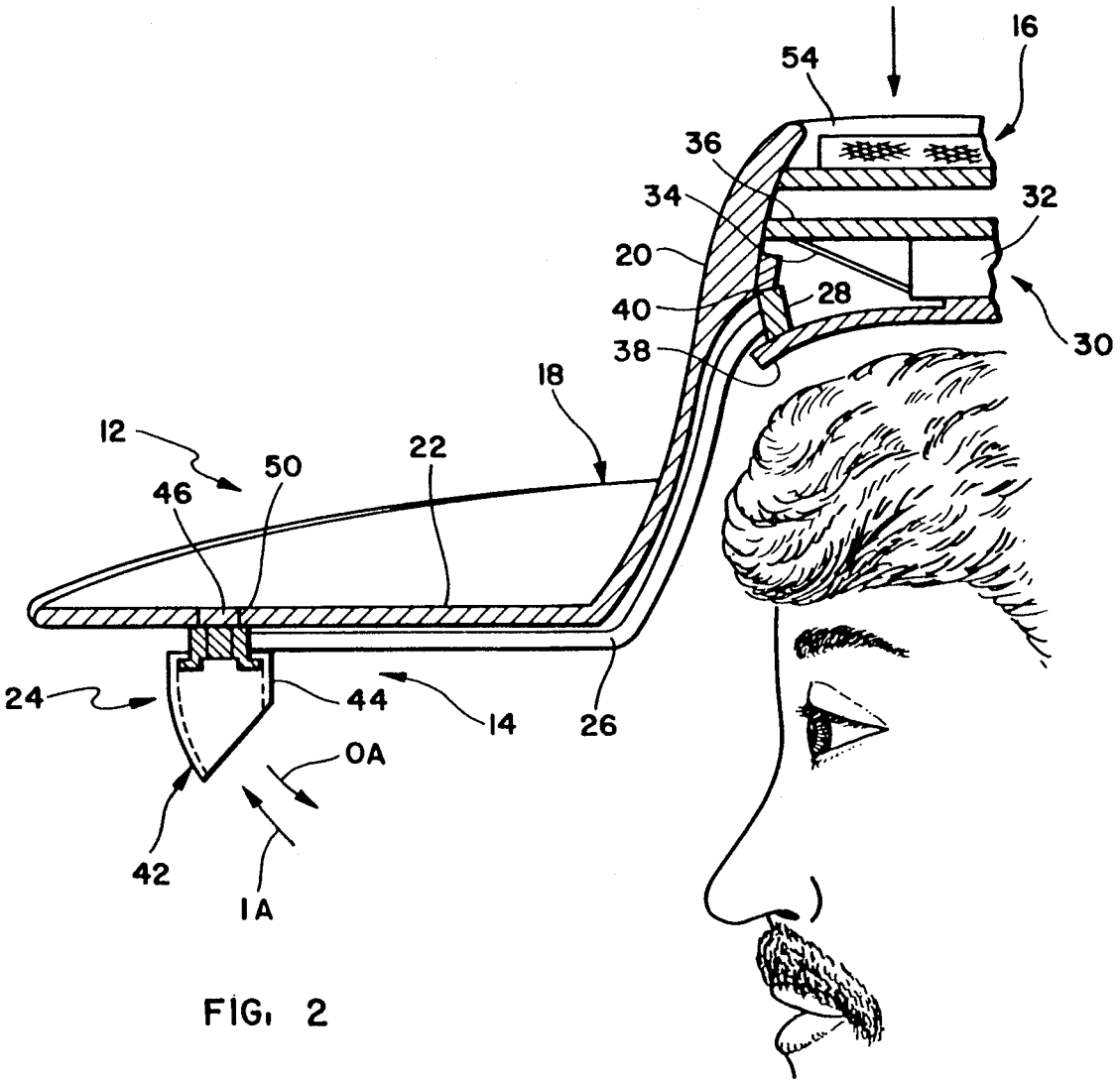
FIG. 2 is a partial vertical sectional view of the air directing apparatus shown in FIG. 1 taken along line 2—2 thereof, depicting one mode of operation of the apparatus.
Figure 3:
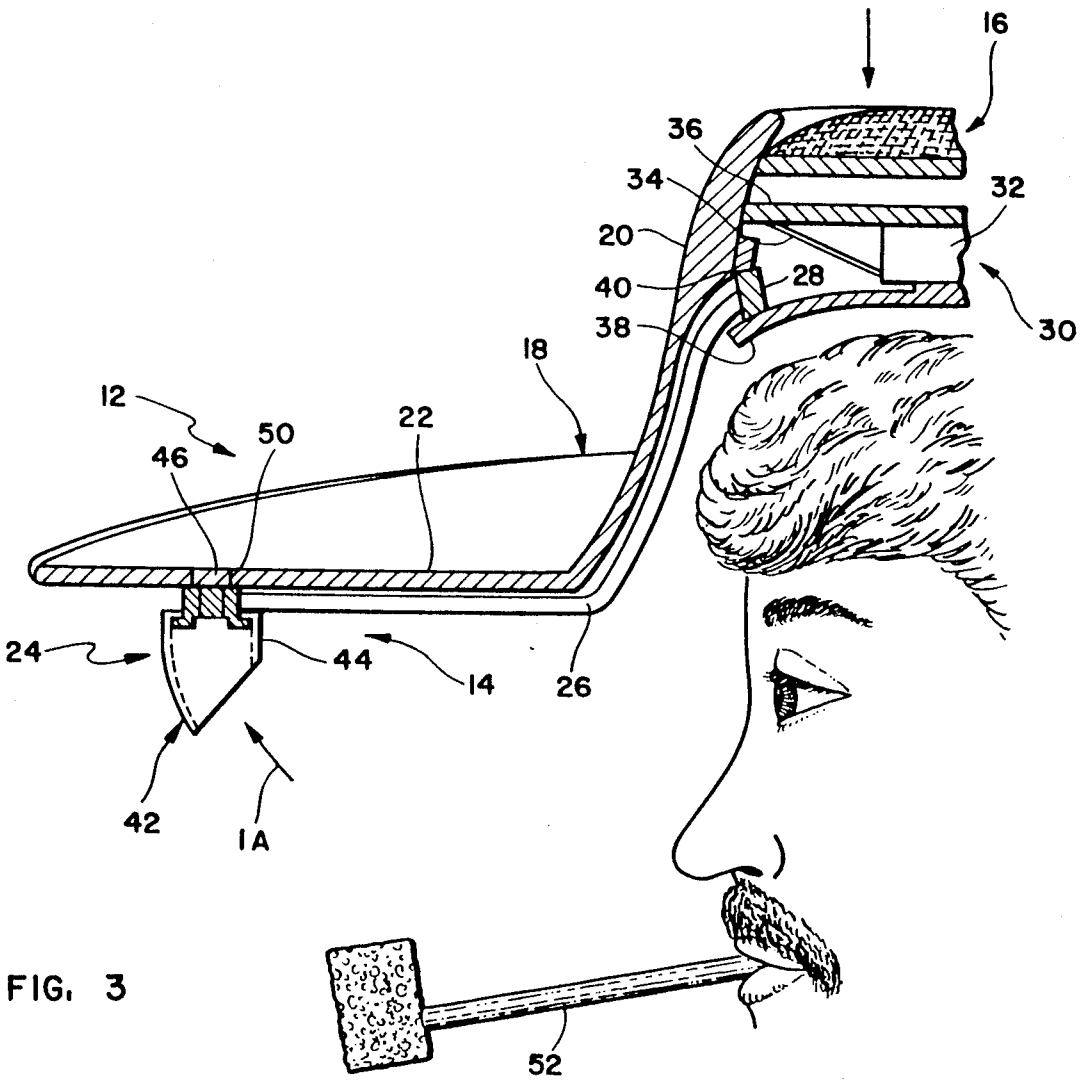
FIG. 3 is another partial vertical sectional view similar to FIG. 2 depicting an alternative mode of operation of the air directing apparatus.

In FIGS. 1–3, one embodiment of the air flow directing apparatus of the present invention is illustrated and is generally designated as 10. The air flow directing apparatus 10 includes a housing 12 for removably mounting the apparatus on a person's head, a means 14, mounted to the housing 12, for guiding a stream of air flowing in a direction frontwardly of the person's face and a filter means 16 for filtering the stream of air.

The housing 12 includes a hat means 18 for covering the head of the person having a frusto-conical portion 20 and a visor portion 22 extending horizontally from the larger rim of the frusto-conical portion 20. The hat means 18 can be formed of conventional hat material such as, for example, felt material, which is molded to form a covering which extends at least forwardly of the person's head and, preferably, rearwardly and to the sides of the person's head, for providing protection against sunshine, rain and other elements.

The air guiding means 14 includes a means 24 for intaking ambient air into the frusto-conical portion 20 of the hat means 18. The ambient air intake means 24 includes a conduit portion 26, one end of which is fixedly mounted to a ring member 28. The ambient air intake means 24 additionally includes a fan assembly 30. The fan assembly 30 includes a conventional selectively reversible, battery powered fan 32, the housing of the fan 32 being fixedly mounted by a plurality of struts 34 to a mounting ring 36. As seen in FIG. 2, the mounting ring 36 is fixedly mounted by appropriate conventional securement means to the inner surface of the frusto-conical portion 20 of the hat means 18. A guide plate 38 is fixedly mounted to the bottom of the housing of the fan 32.

A support ring member 40 is fixedly mounted by appropriate conventional securement means to the inner surface of the frusto-conical portion 20 of the hat means 18 and cooperates with the guide plate 38 to rotatably support the ring member 28 for rotation of the ring member about a rotation axis RA. The conduit portion 26 extends from the ring member 28 in relatively closely adjacent relation along the inner surface of the frusto-conical portion 20 and the lower surface of the visor portion 22 to terminate at its other end at a tubular directional component 42. The directional component 42 includes a contoured body portion 44 for directing air into and out of the conduit portion 26 and a track following portion 46. As seen in FIG. 1, the track following portion 46 is adapted to movably mount the directional component 42 for orbital movement about the axis RA along an annular track 50 formed in the visor portion 22 of the hat means 18. As can be understood, the directional component 42, the conduit 26 and the ring member 28 form a single unitary assembly.

The filter means 16 is formed of an appropriate conventional air filtering material having the capability to remove selected by-products released during the smoking of tobacco products, as well as other air borne pollutants and the like.

In operation, the person mounts the air flow handling apparatus on his or her head with the directional member 42 positioned along the track 50 at a desired location, e.g., generally centrally forwardly of his or her face. In preparation for the smoking of a tobacco product contained in a smoking means such as, for example, a pipe 52 as shown in FIG. 3, the person actuates the fan 32 to create an intake stream of air IA. Accordingly, when the smoke and other by-products of the burning tobacco product exit the pipe 52, the intake stream of air IA, which comprises ambient air flowing inwardly into the directional component 42, entrains the smoke and other by-products and carries the smoke and other by-products along the conduit 26.

The fan 32 propels the smoke and other by-products into and through the filter means 16. To the extent possible, the smoke and other by-products are trapped in the filter means 16 so that substantially only otherwise unpolluted air exits the filter means 16 into the air space above the air flow handling apparatus 10. To accommodate differing ambient air flow patterns in front of the person's face due to, for example, the positioning of the pipe 52, the directional component 42 can be appropriately moved along the annular track 50. As can be understood, the movement of the directional component 42 along the annular track 50 produces corresponding orbital movement of the ring member 28 about the rotational axis RA due to the unitary interconnection of the directional component 42, the conduit 26 and the ring member 28.

As seen in FIG. 2, the air flow handling apparatus 10 can be alternatively operated to guide a stream of outlet air OA outwardly from the directional component 42 to flow in a direction frontwardly of the person's face. In this regard, the filter means 16 can include a conventional air filtering medium for filtering entrained particles such as, for example, pollen particles, or an appropriate conventional air cooling medium such as, for example, a freezable gel 54 (shown in FIG. 2) in lieu of or in addition to the tobacco by-product-type filter material. In the outlet air mode of operation of the air flow handling apparatus 10, the rotation of the fan 32 is reversed and ambient air is drawn through the top of the hat means 18 to flow through the filter 16 and/or the freezable gel 54 for cooling of the drawn-in air. The intake air is then forced by operation of the fan 32 through the conduit 26 and the directional component 42 to be directed frontwardly of the person's face. Thus, a person can enjoy the benefits of a relatively pollutant-free and/or cooler air flow frontwardly of his or her face while operating in a relatively warm environment.

The present invention also contemplates that the fan assembly 30 and the filter means 16 could be located externally of the hat means. For example, the fan assembly 30 and the filter means 16 could be mounted in a carrying case adapted to be mounted on the user's belt or in a backpack to be worn on the user's back. A flexible conduit or other appropriate means could communicate the filter means 16 and the fan assembly 30 in the belt mounted carrying case or backpack with the hat means 18. In operation, the fan assembly 30 would selectively propel or exhaust air through the flexible conduit to the hat means 18.

The present invention additionally contemplates that the frusto-conical portion 20 and the visor portion 22 can be constructed with compatibly configured double layer portions for performing a conduit function between the ambient air intake means 24 and the fan assembly 30 in lieu of the conduit portion 26. The double layer construction would include an extension of the guide plate 38 extending in generally parallel, spaced relation with the sloped lower surface of the frusto-conical portion 20 and further extending beyond the frusto-conical portion 20 in generally parallel, spaced relation with the lower surface of the visor portion 22 to terminate at the track 50. The open space between the extension of the guide plate 38 and the lower surfaces of the frusto-conical portion 20 and the visor portion 22 would permit air to flow therein between the ambient air intake means 24 and the fan assembly 30 in any selected location of the ambient air intake means 24 along the track 50. In such embodiment, the ambient air intake means 24 could alternatively comprise an arcuate slide member disposed slidably within the track 50 to close a predetermined arcuate extent thereof while leaving the remaining extent of the track 50 open to form an ambient air intake opening. Sliding movement of the slide member within the track would enable the opening to be selectively positioned at any desired location about the head of the wearer.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A hat-like apparatus for directing air adjacent the head of a person, comprising:

a housing removably mountable on the person'head; and means mounted to said housing, for directing a stream of air to flow adjacent the person's head, said air directing means including means for selectively positioning an air flow opening along a path extending at least partially about the person'head.

2. A hat-like apparatus according to claim 1 and characterized further in that said housing is in the form of a hat for covering the head of the person to protect the head of the person from weather elements.

3. A hat-like apparatus according to claim 1 and characterized further in that said air stream directing means includes means for intaking ambient air into said housing, the intake ambient air flowing in front of the person's face when the apparatus is worn by the person.

4. A hat-like apparatus according to claim 3 and characterized further in that said filter means filters the intake ambient air to produce filtered air and characterized further by means for exhausting the filtered air from said housing.

5. A hat-like apparatus according to claim 1 wherein said housing is adapted to be removably mounted on the head of a smoker who releases combustion products during the smoking of tobacco-type products and characterized further in that said air stream directing means includes means for intaking ambient air into said housing, filter means for filtering air and means for exhausting the filtered air from the hat-like apparatus, the intake ambient air flowing in front of the smoker's face when the hat-like apparatus is worn by the smoker, and said filter means includes means for removing combustion products from the intake ambient air which have been released by the smoker thereinto to produce filtered air.

6. A hat-like apparatus according to claim 5 and characterized further by a visor dependingly attached to said housing and partially covering the face of the smoker when said housing is worn by the smoker.

7. A hat-like apparatus for directing air adjacent the head of a person according to claim 1 and characterized further by filter means for filtering said stream of air.

8. A hat-like apparatus according to claim 1 and characterized further in that said path extends arcuately about the person'head.

9. A hat-like apparatus according to claim 1 and characterized further in that said housing includes hat means for covering the head of the person and said air stream directing means includes means defining said first-mentioned air flow opening, means defining a second air flow opening spaced from said first opening and conduit means extending between said first and second openings in general conformity to a surface of said hat means.

10. A hat-like apparatus according to claim 9 characterized further in that said air stream directing means includes a selectively reversible fan means mounted to said hat means, said fan means being operatively associated with said second opening and selectively reversible to intake ambient air flowing along the person'head through said first opening and to expel said ambient air through said second opening and to draw intake ambient air though said second opening and to expel said intake ambient air through said first opening to flow along the person's head.

11. A hat-like apparatus for directing air flowing at the level of a person'face, comprising:

a housing removably mountable on the person'head;

means, mounted to said housing, for directing a stream of air to flow in a direction frontwardly of the person'face, said air stream directing means including a selectively reversible fan means mounted to said housing and conduit means including a ring member forming a first opening disposed frontwardly of the person's face when the hat-like apparatus is worn by the person, means for supporting said ring member for orbital movement relative to said housing to affect selective positioning of said first opening relative to the person's face, and a second opening spaced from said first opening, said fan means being operatively associated with said conduit means and selectively reversible to intake ambient air flowing in front of the person's face through said first opening and to expel said ambient air through said second opening and to draw intake ambient air through said second opening and to expel the ambient air through said first opening to flow in front of the person's face; and filter means for filtering the stream of air.

* * * * *

UNITED STATES PATENT AND TRADEMARK OFFICE

CERTIFICATE OF CORRECTION

PATENT NO. : 5,085,231

DATED : Feb. 4, 1992

INVENTOR(S) : Ronald A. Johnson

It is certified that error appears in the above-identified patent and that said Letters Patent is hereby corrected as shown below:

Column 1, Line 34, after "filter" insert -- means --.

Column 5, Line 3, delete "person'head" and insert -- person's head -- therefor.

Column 5, Line 9, delete "person'head" and insert -- person's head -- therefor.

Column 6, Line 3, delete "person'head" and insert -- person's head -- therefor.

Column 6, Line 12, after "claim 9" insert -- and --.

Column 6, Line 17, delete "person'head" and insert -- person's head -- therefor.

Column 6, Line 20, delete "though" and insert -- through -- therefor.

Column 6, Line 24, delete "person'face" and insert -- person's face -- therefor.

Column 6, Line 25, delete "person'head" and insert -- person's head -- therefor.

Column 6, Line 28, delete "person'face" and insert -- person's face -- therefor.

Column 6, Line 35, delete "affect" and insert -- effect -- therefor.

Signed and Sealed this

First Day of June, 1993

*Attest:*

Michael K. Kirk

MICHAEL K. KIRK

*Attesting Officer*

*Acting Commissioner of Patents and Trademarks*